US009182174B2

(12) United States Patent
Jegatheeswaram Pillai et al.

(10) Patent No.: US 9,182,174 B2
(45) Date of Patent: Nov. 10, 2015

(54) FLUIDISED BED TREATMENT

(71) Applicant: ROLLS-ROYCE PLC, London (GB)

(72) Inventors: Bhrami Jegatheeswaram Pillai, Derby (GB); Daniel Clark, Derby (GB); Paul Anthony Goulding, Derby (GB); Daniel Jason Howe, Hereford (GB); Kin Keung Chan, Dudley (GB); Ian Edward Mitchell, Derby (GB)

(73) Assignee: ROLLS-ROYCE plc, London (GB)

( * ) Notice: Subject to any disclaimer, the term of this patent is extended or adjusted under 35 U.S.C. 154(b) by 406 days.

(21) Appl. No.: 13/683,326

(22) Filed: Nov. 21, 2012

(65) Prior Publication Data

US 2013/0149658 A1 Jun. 13, 2013

(30) Foreign Application Priority Data

Dec. 13, 2011 (GB) ..... 1121351.9

(51) Int. Cl.
*C21D 1/53* (2006.01)
*F27B 15/02* (2006.01)
(Continued)

(52) U.S. Cl.
CPC . *F27B 15/02* (2013.01); *C21D 1/53* (2013.01); *C21D 1/74* (2013.01); *C21D 9/0062* (2013.01); *F27B 15/18* (2013.01); *F27D 99/0073* (2013.01); *C21D 2221/00* (2013.01)

(58) Field of Classification Search
CPC ..... F27B 15/10; F27B 15/00; F27B 15/02; F27B 15/14; F28C 3/16; F26B 3/08; F26B 3/092; C21D 1/53; C21D 9/567; C21D 1/74; C21D 2221/00; C21D 9/0062; B05C 19/02; B05C 19/025; B05C 21/00
USPC ..... 118/DIG. 5, 303, 308, 309; 432/14, 58
See application file for complete search history.

(56) References Cited

U.S. PATENT DOCUMENTS 3,197,328 A 7/1965 Jung et al.
3,396,699 A 8/1968 Beebe et al.
(Continued)

FOREIGN PATENT DOCUMENTS

DE 34 29 707 C1 9/1985
DE 10 2010 027 179 B3 11/2011
(Continued)

OTHER PUBLICATIONS

European Search Report issued in European Application No. 12 19 3535 dated Mar. 12, 2013.
Search Report issued in British Application No. 1121351.9 dated Jun. 26, 2012.

*Primary Examiner* — Steven B McAllister
*Assistant Examiner* — Ko-Wei Lin
(74) *Attorney, Agent, or Firm* — Oliff PLC

(57) ABSTRACT

A component is treated in a fluidized bed by insertion of only a treatment part of the component into the treatment chamber of a fluidized bed apparatus. The non-treatment part of the component is located substantially outside the treatment chamber and out of contact with the fluidized bed. The boundary between the treatment part and the non-treatment part of the component is defined by a boundary containment surface at a fixed location with respect to the component. The boundary containment surface may be a seal which seals between the component to be treated and an aperture in a side wall of the treatment chamber.

10 Claims, 3 Drawing Sheets

(51) Int. Cl.

| | |
|---|---|
| ***C21D 1/74*** | (2006.01) |
| ***C21D 9/00*** | (2006.01) |
| ***F27B 15/18*** | (2006.01) |
| ***F27D 99/00*** | (2010.01) |

(56) References Cited

U.S. PATENT DOCUMENTS

| | | | | |
|---|---|---|---|---|
| 3,519,497 | A | | 7/1970 | Pomey |
| 5,140,935 | A | * | 8/1992 | Gruber ..... 118/621 |

FOREIGN PATENT DOCUMENTS

| | | | | |
|---|---|---|---|---|
| EP | 1 354 967 | A1 | | 10/2003 |
| EP | 2 537 945 | A2 | | 12/2012 |
| GB | 906349 | | * | 10/1959 |
| GB | 906349 | | | 9/1962 |
| JP | A-60-016294 | | | 1/1985 |
| JP | A-01-180919 | | | 7/1989 |
| JP | A-2003-013142 | | | 1/2003 |
| JP | A-2005-059054 | | | 3/2005 |

* cited by examiner

FLUIDISED BED TREATMENT

FIELD OF THE INVENTION

The present invention relates to methods of treatment of components using fluidised beds and to apparatus for carrying out such methods. The invention has particular, but not exclusive, application to the thermal treatment of components, such as metallic components. Suitable thermal treatments typically include heat treatment but may also include cooling treatment. Suitable thermal treatments may be applied to a component in order to promote stress relief and/or the development of a preferred microstructure, for example, in order to obtain desired mechanical properties. The invention has particular applicability to the treatment of turbomachinery blades, but the invention is not necessarily limited to the treatment of such components.

BACKGROUND OF THE INVENTION

A fluidised bed typically consists of a bed of solid particles in the form of a powder (referred to as "media" or "solid media") situated on a distributor plate located above a plenum chamber. The distributor plate has an arrangement of many gas flow passages through it. Introduction of a process gas into the plenum chamber creates a pressure drop across the distributor plate. The resultant flow of process gas into the bed of media causes fluidisation. The result is a heterogeneous mixture of the process gas and solid particles that behaves macroscopically as a fluid.

Fluidised beds typically provide a very high surface area contact between the fluidising gas and the solid media, compared with the contact area available for a packed solid bed. Fluidised beds also provide very good thermal transfer between the walls of the fluidised bed apparatus, the fluidising gas, the media and any component located in the media. This is due to the high surface area contact between the fluidising gas and the solid media and due to the very frequent particle-particle, particle-wall and particle-component collisions.

Fluidised bed apparatus typically have rectangular or cylindrical configurations.

It is known to use fluidised beds in order to provide a controlled heat treatment for components, for example in order to provide a hardness gradient within the component. Some example disclosures are discussed below.

U.S. Pat. No. 3,519,497 discloses a method of controlling the cooling of a rail section. The rail section is subjected to hot rolling and is immediately submerged in a fluidised bed. The fluidised bed is maintained at a predetermined temperature, in order to provide isothermal conditions for a bainitic microstructural transformation. The rail section is held in the fluidised bed in a particular orientation in order to provide stagnant regions of the flow in the fluidised bed. In turn, this affects the rate of cooling to which different parts of the rail section are subjected, and so affects the hardness/metallurgical properties throughout the rail section.

DE-C-3429707 discloses a method of locally hardening drill bits. A cartridge is loaded with drill bits. The cartridge is submerged into a fluidised bed. The cartridge holds the drill bits in such a way that, for each drill bit, only the surface to be treated is exposed whilst the remainder is shielded with insulation. This allows a custom boundary/interface to be achieved for varying component geometries.

In the two documents discussed above, the entire component is submerged in the fluidised bed, but special measures are taken in order to achieve differential heat treatment of different parts of the component.

Other documents disclose the submersion of only a part of the component to be treated, in order to ensure that only the submerged part is subjected to the required heat treatment. The intention here is also to provide a localised heat treatment in order to produce a controlled and sustained thermal gradient within and across the component.

For example, JP-A-2005-059054 discloses the use of a fluidised bed to create a high temperature gradient within a component. The component is partially dipped in at the top of the bed for localised heat treatment to induce a temperature gradient. FIGS. 2, 3 and 4 of JP-A-2005-059054 show how the component is suspended above the top of the bed and the part of the component to be treated is lowered into the bed.

JP-A-2003-013142 discloses heat treatment of a pipe section. The pipe section has a major portion formed with a constant, relatively small, wall thickness. A connection portion at the end of the pipe section, however, has a greater wall thickness. In order to apply the same heat treatment to the different parts of the pipe section, when taking into account the different wall thickness, the connection portion of the pipe is dipped into a fluidised bed, in order to provide a heat treatment specific to that part of the pipe section. The entire pipe section is held in a furnace in order to provide a heat treatment specific to the major portion of the pipe section.

SUMMARY OF THE INVENTION

The present inventors have realised that there are drawbacks with the methods and apparatus discussed above, when the aim is to provide local heat treatment of only part of a component.

Partially submerging a component in the fluidised media can lead to poor repeatability of the heat treatment process. This is because the surface of the fluidised media is not perfectly level but instead the local height of the surface fluctuates randomly, due to bubbling. Thus there is the problem that it can be very difficult to obtain an even exposure level of the chosen part of the component for heat treatment.

The restrictions of gravity mean that the surface of the fluidised media (ignoring the local random fluctuations mentioned above) is horizontal. This affects the parts, shape and orientation of the component that can be treated. Typically, if it is wanted to subject more than one part of the component to the same heat treatment at the same time, these parts of the component must be located on the component in such a disposition as to allow simultaneous submersion of these parts in the fluidised media.

With respect to U.S. Pat. No. 3,519,497, this document discloses submerging the entire component into the fluidised bed and yet still obtaining different rates of cooling at different parts of the component. However, the disclosure of U.S. Pat. No. 3,519,497 is still effectively a 'global' heat transfer process, and it would be difficult to modify that disclosure in order to achieve a highly localised application of heat treatment to a component.

With respect to DE-C-3429707, it is considered likely that the insulated parts of the components submerged into the fluidised media would still be subjected to unwanted heat treatment over prolonged time. Still further, it is considered that it would be difficult to apply the teaching of DE-C-3429707 to large components, because this would involve manufacturing a large container that could encapsulate and protect sections of the 1 component that should be protected from the heat treatment.

The present invention has been devised in order to address at least one (and preferably all) of the problems mentioned above. In preferred embodiments, the present invention reduces, ameliorates, avoids or even overcomes one or more of these problems.

The present inventors have considered the situation in which part of a component is submerged under the surface of a fluidised bed, leaving the remainder of the component projecting from the surface of the fluidised bed. The inventors have realised that the boundary between the part of the component to be treated and the remainder of the component is constrained by the global horizontal arrangement of the surface of the fluidised bed and the locally random irregularly fluctuating shape of the surface of the fluidised bed. Instead of this, the inventors propose that the boundary between the part of the component to be treated and the reminder of the component should be defined by a boundary containment surface of the fluidised bed. Such a surface can be located with precision, and need not be horizontal, nor planar. This allows the repeatability of the treatment to be improved, and also improves the flexibility of the process, in terms of treating different parts of different components.

Since devising the present invention, the present inventors have come across U.S. Pat. No. 3,396,699, which discloses a method for drawing wire through a cloud of charged particles above a fluidised bed. The fluidised bed is formed in the base of a chamber and the wire is drawn into the chamber through a side wall of the chamber, above the horizontal surface of the fluidised bed. The wire is earthed and the particles in the cloud are charged, such that the particles are deposited in a layer on the wire. The coated wire is then transferred from the chamber to a furnace for consolidation of the coating. The process is continuous, in that the wire is continuously drawn through the chamber and the heat treatment in the adjacent furnace is correspondingly continuous.

In a first preferred aspect, the present invention provides a process for the treatment of a component using a fluidised bed of solid particles, wherein the fluidised bed is formed in a treatment chamber and retained in the treatment chamber by one or more containment surfaces and at least one treatment part of the component is placed in the fluidised bed and at least one non-treatment part of the component is located substantially outside the chamber and out of contact with the fluidised bed, wherein the boundary between the treatment part and the non-treatment part of the component is defined by a boundary containment surface at a fixed location with respect to the component.

In a second preferred aspect, the present invention provides an apparatus for the treatment of a component using a fluidised bed, the apparatus comprising a treatment chamber, the fluidised bed in use being retained in the treatment chamber by one or more containment surfaces, the apparatus being adapted to allow at least one treatment part of the component to be placed in the fluidised bed and at least one non-treatment part of the component to be located substantially outside the chamber and out of contact with the fluidised bed, wherein in use the boundary between the treatment part and the non-treatment part of the component is defined by a boundary containment surface at a fixed location with respect to the component.

In a third preferred aspect, the present invention provides a kit of parts suitable for assembling an apparatus according to the second aspect, wherein the kit includes two or more interchangeable boundary containment surfaces of different shape, in order to adapt the treatment chamber to different shapes of specific components to be treated by selection of at least one of the two or more interchangeable boundary containment surfaces to be used in assembling the apparatus.

The first, second and/or third aspect of the invention may have any one or, to the extent that they are compatible, any combination of the following optional features.

The use of a boundary containment surface in order to define the part of the component to be treated avoids the problem discussed above in relation to the locally random irregularly fluctuating shape of the surface of the fluidised bed. Furthermore, allowing the non-treatment part of the component to extend out of the treatment chamber means that large components can be treated according to the invention, without the need for a correspondingly large treatment chamber, fluidised bed and shield (for shielding the non-treatment part of the component inside the large treatment chamber).

Preferably, the apparatus is adjustable in order to adjust the position of the component with respect to the fluidised bed. For example, the depth of submersion of the treatment part may be adjustable, by suitable adjustment of the location of the component and the boundary containment surface.

The fluidised bed may be fluidised by vibration, for example. However, preferably fluidisation of the bed is by a flow of fluidising gas. A combination of gas flow and vibration may be used.

Preferably, the treatment chamber has at least one side wall, in order to restrain lateral flow of the fluidised bed, the side wall thereby forming part of the boundary containment surface. Preferably, the component is disposed with respect to the treatment chamber so that the treatment part of the component is located within the treatment chamber on one side of the side wall and so that the non-treatment part of the component is located on the other side of the side wall, outside the treatment chamber. In this way, the side wall provides a definite and fixed limit to the contact between the treatment portion and the fluidised bed.

Preferably, the side wall is adapted to the shape of the component. Thus, the side wall preferably has one or more apertures corresponding in shape and location to the treatment parts of the component.

Forming multiple apertures in the side wall as discussed above allows a corresponding number of components, or multiple parts of one component, to be treated by the fluidised bed at the same time, if required.

In some embodiments, the side wall may be non-planar in order to accommodate a required non-planar boundary between the treatment parts and non-treatment parts of the component. For example, the side wall may be curved. More complex shapes, to correspond with more complex components, are of course easily envisaged and produced.

Preferably, the boundary containment surface includes at least one seal member to seal between the component and the treatment chamber (e.g. the side wall of the treatment chamber). The seal member is typically locatable in an aperture in the side wall, as mentioned above. The seal member may be shaped to complement the component shape, in order to adapt the component shape to an aperture in the side wall of the treatment chamber. In this way, one treatment chamber may be used in order to treat a series of different components of different (but typically generally similar) shapes, by providing a corresponding series of seal members. Typically, the seal member is compressible to accommodate the component. For example, a hollow seal member may be used, a hollow cavity within the seal capable of being deformed in order to fit between the side wall of the treatment chamber and the component.

Additionally or alternatively, the side wall of the treatment chamber may be replaceable, e.g. in order to adapt the treatment chamber to a more radical difference in shape between components to be treated.

Thus, in the kit of parts, the interchangeable boundary containment surfaces may be provided by a series of seal means of different shape as mentioned above and/or by a series of side walls of different shape.

In some preferred embodiments, the component may have two or more treatment parts. It is preferred, where possible, that these treatment parts are treated in the fluidised bed simultaneously. Thus, preferably the apparatus includes a corresponding plurality of boundary containment surfaces in order to define the boundary between each treatment part and the non-treatment part(s).

Where the component has two or more treatment parts, the apparatus and/or method may be adapted to allow different treatment of the treatment parts using the fluidised bed. For example, the fluidising gas flow at a first region corresponding to a first treatment part may be different to the fluidising gas flow at a second region corresponding to a second treatment part. This can be achieved by blanking off a respective part of the distributor plate of the apparatus, and/or a variation in the treatment chamber dimensions, and/or a diversionary gas stream bifurcation to regulate pressure. Additionally or alternatively, the first treatment part may have shield means applied (e.g. insulation, or deliberate stagnation to vary temperature/heat transfer coefficient as a means of insulation) different to the second treatment part.

The overall shape of the treatment chamber may, for example, be based on a rectangular shape, a parallelogram shape, a cylindrical shape, an annular shape or a partial annular shape (e.g. half-annular shape). The overall shape of the treatment chamber does not necessarily need to follow the shape of the component, but in some embodiments this is preferred.

The preferred embodiments of the invention have particular utility in the heat treatment of parts of components, e.g. in order to control the mechanical properties of the components. Suitable heat treatments include controlling the temperature of the treatment part so that the treatment part has a higher or lower temperature (sustained across a region for a time) than the non-treatment part. Additionally or alternatively, suitable heat treatments include controlling the temperature of the treatment part so that the treatment part has a higher or lower rate of change of temperature than the non-treatment part.

However, the present invention is not necessarily limited to such heat treatments. The concept of the present invention may be applied to other uses of fluidised beds, such as the use of such beds to carry out chemical reactions. Thus, any suitable application of fluidised beds can benefit from introducing a component at the side of the bed. The present invention preferably allows local, more uniform media flow around a component that is not easily achievable by other methods.

Where the apparatus is used for heat treatment, the solid particles may be independently heated. For example, the solid particles may be circulated or re-circulated from a reservoir of particles. The reservoir may be heated. Alternatively, the particles may be derived from a powder stream. This may be entirely separate or a bulk region within the bed that has lateral circulation.

The solid particles may have any suitable size/shape/density distribution in order to carry out the required treatment in an efficient manner. For example, the population of solid particles may have a multi-modal size/shape/density distribution.

The fluidising gas may be independently heated.

Preferably, the fluidising gas is recycled. For example, the fluidising gas may be extracted from the treatment chamber and subjected to filtration and/or cleaning. Cleaning may be carried out by a chemical scrubbing system. The filtered/cleaned gas may then be used again as the fluidising gas. It is possible for the treatment chamber and fluidising gas filtration/cleaning system to be housed within a sealed chamber containing only the fluidising gas.

Preferably, the apparatus includes a heat exchange system in order to extract waste heat from exhaust gas from the fluidised bed. This allows improvement of efficiency of the system.

Temperature in the process can be monitored directly, e.g. using one or more thermocouples in the bed. Additionally or alternatively, temperature may be monitored indirectly, measurement of flow of fluidising gas, power input, exit gas temperatures, etc.

Preferably, in use, less than 50% by volume of the component is contained in the treatment part(s) of the component. Thus, preferably, the majority of the component is not located in the fluidised bed.

In the process, it is preferred that the component is initially installed in the treatment chamber before the solid particle bed is fluidised. In this case, the treatment part(s) of the component are preferably located above the surface of the solid particle bed before fluidisation. On fluidisation, the treatment part(s) of the component are then preferably completely submerged under the rising surface of the fluidised bed. This is advantageous because it allows the component to be installed in the treatment chamber without risking loss of the media.

More generally, in the process, it is possible for the component to be brought to the treatment chamber for treatment, as implied above. However, for larger components, it may be preferred for the treatment chamber to be portable, in order to treat the component in situ. Additionally or alternatively, the treatment chamber may be assembled around the treatment part of the component. In this case, typically, the media for the fluidised bed is added after assembly of the treatment chamber around the treatment part of the component. In some embodiments, it may be preferred for the apparatus to be provided in a clam-shell-like arrangement, in order to embrace and seal with the component in order to treat the treatment part.

In some preferred embodiments, the treatment chamber may be configured to receive the component in one orientation of the treatment chamber, and then to treat the component in another orientation of the treatment chamber. For example, the treatment chamber can be tilted (e.g. by pivoting) to an orientation in which the one or more openings for receiving the component face substantially upwardly. This allows the particles (for use in, the fluidised bed) to flow away from the opening and therefore reduces the risk of loss of some of the particles from the opening. The component may then be inserted through the opening. Then the treatment chamber may be tilted (e.g. again by pivoting) to an orientation in which the fluidised bad covers the part of the component projecting into the treatment chamber. Tilting of the treatment chamber may be achieved with respect to a support on which the treatment chamber is mounted.

Further optional features of the invention are set out below.

BRIEF DESCRIPTION OF THE DRAWINGS

Embodiments of the invention will now be described by way of example with reference to the accompanying drawings in which.

DETAILED DESCRIPTION OF THE PREFERRED EMBODIMENTS, AND FURTHER OPTIONAL FEATURES OF THE INVENTION

The basic design of a fluidised bed involves a bed of solid media (usually alumina powder) situated on a distributor plate (a suitable porous or mesh-like material) located above a plenum chamber. Introduction of a process gas (also referred to herein as a fluidising gas) into the plenum chamber creates a pressure drop across the distributor plate, which in turn fluidises the media above. The holes in the distributor plate, through which the process gas flows, are typically small enough to prevent passage of the solid particles in the reverse direction through the distributor plate. Usually, fluidised beds are either rectangular or cylindrical in shape, the shape being defined by the shape of the plenum chamber and the corresponding distributor plate and also by the configuration of the side wall which contains the fluidised bed from flowing laterally out of the apparatus.

Figure 1:
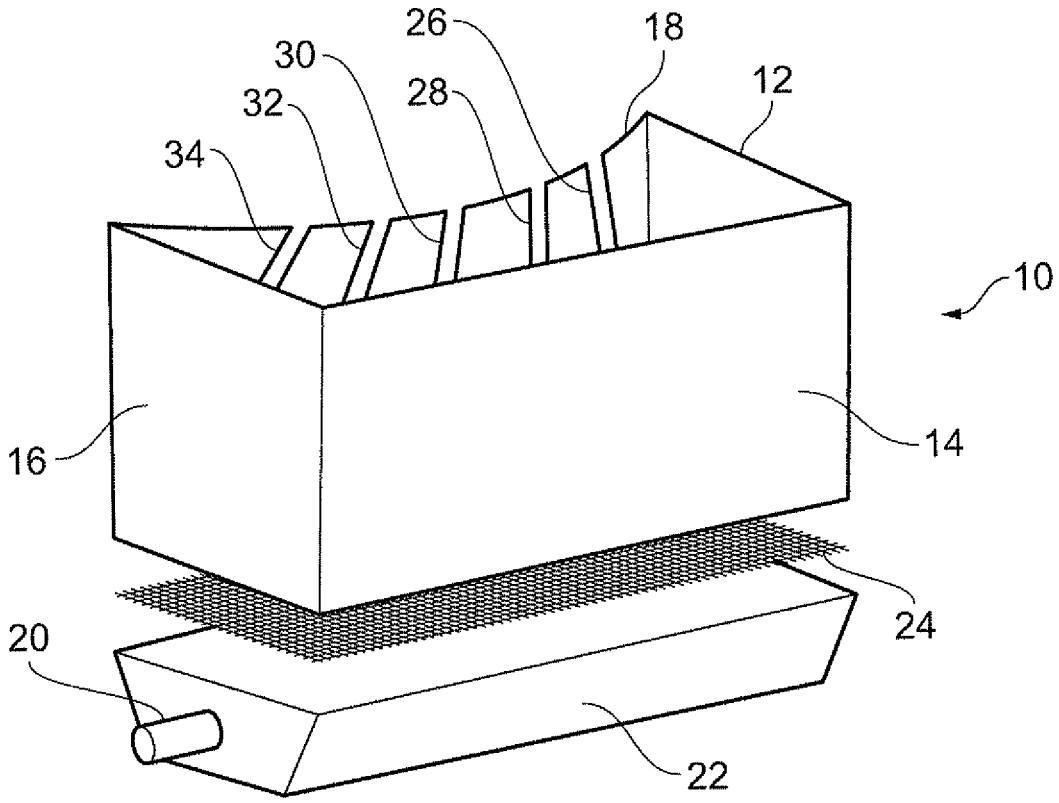
FIG. 1 shows a schematic view of a fluidised bed apparatus for use in an embodiment of the invention.

FIG. 1 shows a schematic view of a fluidised bed apparatus for use in an embodiment of the invention. The apparatus is based on a rectangular bed configuration. The apparatus has a treatment chamber 10 with four side walls. Three of the side walls 12, 14, 16 are vertical in orientation and planar in shape. The remaining side wall 18 is not planar in shape, and is described in further detail below.

The apparatus has a fluidising gas inlet 20 which delivers fluidising gas at an appropriate (and adjustable) pressure to plenum chamber 22. Interposed between plenum chamber 22 and treatment chamber 10 is distributor plate 24. Distributor plate 24 is arranged generally horizontally and is formed of a mesh sized to prevent the particulate (not shown) used as the fluidised bed media from passing from the treatment chamber into the plenum chamber. Any shape, size and type of distributor is envisaged.

Side wall 18 of the treatment chamber attaches to side wall 12 and side wall 16. In some preferred embodiments, side wall 18 may be removably attachable to side wall 12 and side wall 16. In that case, a different side wall, typically of different shape, may be substituted for side wall 18, in order to use the apparatus to treat a different component. A selection of such side walls may be provided in the form of a kit of parts.

Side wall 18 includes an arrangement of apertures 26, 28, 30, 32, 34. Each aperture takes the form of an elongate slot. In this embodiment, each aperture is open at the top of side wall 18, but in other embodiments, one or more of the apertures may not be open at the top of side wall 18. Apertures 26-34 allow treatment parts of a component (or of multiple components) to be inserted into the treatment chamber, whilst a non-treatment part of the component remains outside the treatment chamber.

The general curved shape of side wall 18 is illustrated in FIG. 1. This allows the shape of the non-treatment part of the component to be accommodated outside the treatment chamber, whilst ensuring that the treatment parts of the component are located inside the treatment chamber. It is possible for the majority of the component to remain external to the bed.

In the example illustrated in FIG. 1, the treatment chamber is adapted to treat blades, for example fan blades, compressor blades and/or gas turbine blades of a gas turbine engine, but this could be adapted to treat any component.

Each aperture 26-34 is shaped in order to locate and fit with the component to be treated. Forming each aperture as an elongate slot allows the position (e.g. height) of the treatment parts of the component to be varied in the treatment chamber.

In order to reduce the likelihood of the media from the fluidised bed escaping from the treatment chamber via any gap between the component (not shown in FIG. 1) and apertures 26-34, it is preferred to provide a seal (not shown in FIG. 1) between the component and each aperture. The seal therefore provides a boundary containment surface in order to contain the fluidised bed with respect to the component and the side wall of the treatment chamber.

FIGS. 2-5 illustrate various sealing arrangements for providing the boundary containment surface between the component and the side wall of the treatment chamber.

Figure 2:
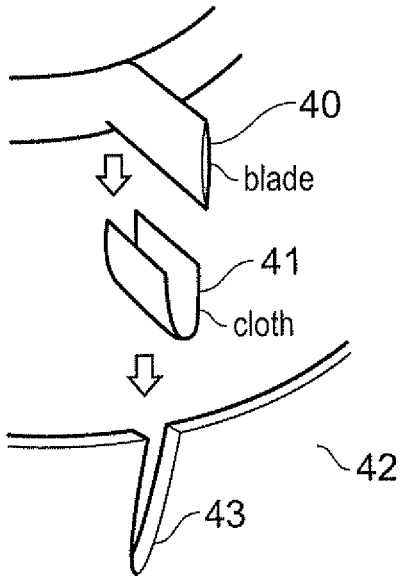
FIG. 2 shows a schematic view of the process of applying a sealing member around a turbine blade and inserting the wrapped turbine blade into an aperture in the side wall of a treatment chamber.

In FIG. 2, a turbomachinery blade 40 is wrapped in a ceramic cloth 41 and the wrapped blade is inserted into aperture 43 in side wall 42 of a treatment chamber. Suitable ceramic cloths are known which can withstand temperatures of around 850° C. Aperture 43 can have a tapered shape, so that as the wrapped component 40 is pressed downwardly, the cloth 41 is compressed between the side wall and the component, giving sealing between the component and the side wall.

Figure 3:
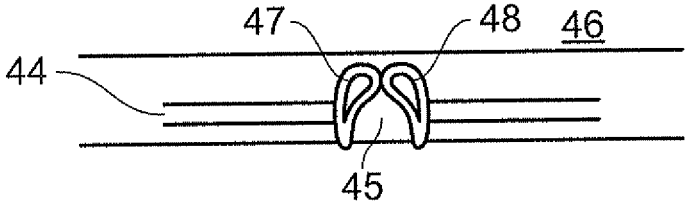
FIG. 3 shows a schematic sectional view of a side wall of a treatment chamber with sealing members sealing across an aperture in the side wall.
Figure 4:
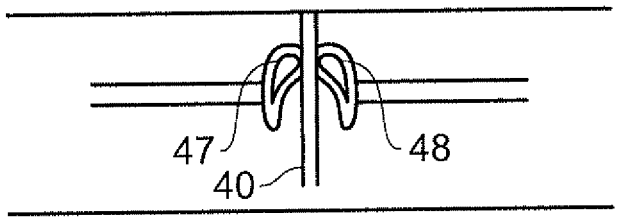
FIG. 4 shows the arrangement of FIG. 3 but with a component projecting through the side wall and sealing with the sealing members.

FIGS. 3 and 4 show schematic cross sectional views of a different arrangement. Side wall 44 of the treatment chamber once more has an aperture 45 formed in it. Fluidised bed powder 46 is provided internally in the treatment chamber. Opposed sealing members 47, 48 are provided at the aperture 45. In FIG. 3, the aperture 45 does not have a component projecting through it, the sealing members 47 and 48 sealing against each other. FIG. 4 shows the same arrangement as FIG. 3, but here blade 40 projects through the aperture 45 and sealing members 47, 48 seal against opposite sides of the blade 40.

Figure 5:
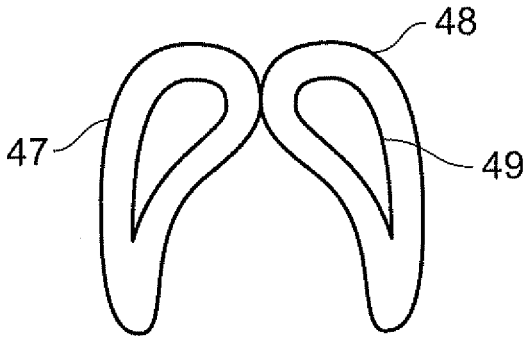
FIG. 5 shows an enlarged schematic sectional view of hollow sealing members suitable for use with the arrangements of FIGS. 3 and 4.

FIG. 5 shows a schematic cross sectional view of sealing members 47 and 48. Each sealing member is hollow, defining an internal cavity 49. The internal cavity allows each sealing member to deform to accommodate the blade 40 and to conform with the shape of the blade 40. Additionally, the cavity allows for the flow of coolant internally along each sealing member. This is of interest in order to prevent overheating of the material of the sealing member.

In use, the treatment part of the component is inserted into the treatment chamber, through at least one of the apertures 26-34, before fluidisation of the particulate (e.g. alumina powder). Therefore the treatment part of the component is located above the upper surface of the non-fluidised bed of powder. The seal is located between the component and the aperture. Any non-used apertures are blanked off using suitable blanking means (not shown). The bed is then fluidised, and the fluidised surface of the bed rises to cover the entire treatment part of the component located in the treatment chamber. The boundary between the treatment part and the non-treatment part of the component is therefore defined by the boundary containment surface, i.e. the seal between the component and the aperture. The equipment could be vibrated to enable loading and unloading.

As explained above, when a fluidised bed is fully operational, the top surface of the fluidised media is typically uneven due to a phenomenon similar to bubbling. As such, if a component is to be partially submersed into the bed, it is very difficult to control and maintain the amount of surface coverage of bed media to component. However, in the preferred embodiment described here, introducing the component at the side of the bed ensures controlled media coverage of the treatment part of the component and a well-defined boundary between the treatment part and the non-treatment part. Thus, the need for creating a level top surface of fluidised media is eliminated. Also, a more uniform temperature gradient across the component in question can be achieved. The design also allows for the component to be adjusted in height relative to the bed if required.

Figure 6:
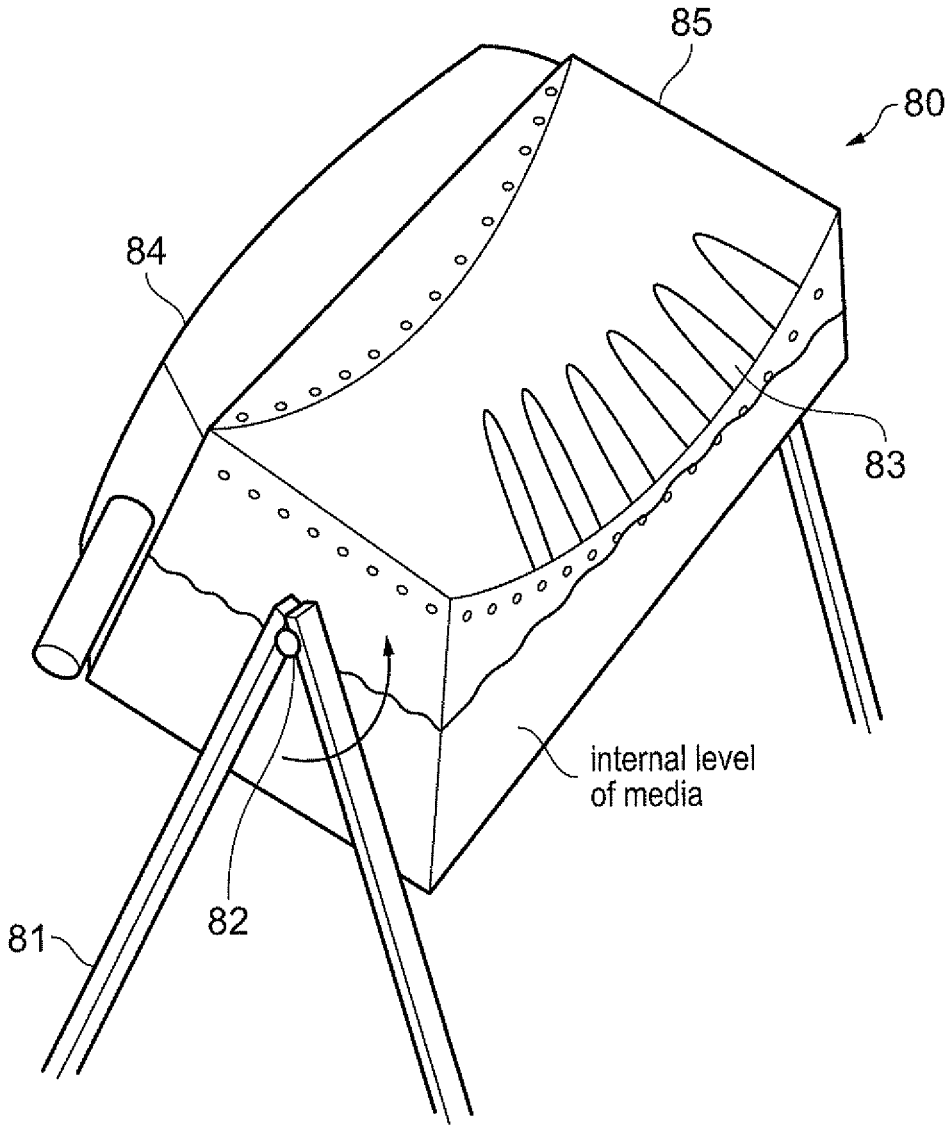
FIG. 6 shows a schematic view of a tiltable treatment chamber for use with an embodiment of the invention.

FIG. 6 schematically illustrates a modification of the embodiments described above. Here, the treatment chamber 80 is supported by a frame 81 via pivot connections 82. The treatment chamber is generally similar to the chamber shown in FIG. 1 except for the support arrangement, the orientation of the side wall containing the apertures 83 and the presence of a covering lid 84. Before use, the treatment chamber is rotated so that apertures 83 face upwardly. The powder for the fluidised bed is therefore held away from the apertures 83 under influence of gravity—the internal level of the powder in the treatment chamber is below the apertures 83. The powder is prevented from falling out of the treatment chamber by covering lid 84. The component (not shown in FIG. 6) is inserted through apertures 83 as previously described, forming a suitable seal with side wall 85 in which the apertures 83 are formed. The treatment chamber can then be rotated back to its operating orientation, the powder fluidised and the component treated. After the treatment, the treatment chamber can be rotated so that apertures 83 face upwardly once more. If desired, side wall 85 may be removed and a new side wall (not shown) (e.g. with a different arrangement of apertures) may be fitted to the treatment chamber, for treatment of a component of different shape. In the preferred embodiment, the purpose of the treatment is to locally heat treat the treatment part of the component, avoiding both over-temperature of the treatment part and over-temperature of the non-treatment part of the component.

Temperature control of the treatment part of the component can be achieved in a direct manner, e.g. using one or more thermocouples in the bed. Alternatively, temperature control can be indirect, through measurement of flows, power input and exit gas temperatures or a combination of the aforementioned.

The particulate may have a multi-modal size, shape or density distribution, in order to provide a desired treatment efficacy.

The particulate may be heated by the fluidising gas. Additionally or alternatively, the powder may be heated independently. The powder may be circulated or re-circulated from a larger heated reservoir or powder stream. A heat exchange system may be used in order to increase the efficiency of operation of the system.

Air may be used as the fluidising gas. Alternatively, other known fluidising gases may be used. The fluidising gas may be recycled using a particle filter and/or a chemical scrubbing system.

As will be understood by the skilled person, it is not essential to ensure that the flow of powder in the fluidised bed is constant in all locations. Indeed, differential flow in different regions of the bed may provide advantageous effects. Thus, one or more different regions of the bed may be blanked off or made stagnant. This can be achieved using specific insulation or purposeful localised particle stagnation. Further means for achieving differential treatment can be provided by providing localised differential fluidising gas flow, e.g. by appropriate control of the gas flow in the plenum chamber. A diversionary gas stream bifurcation may be used to regulate pressure.

The shape of the treatment chamber shown in FIG. 1 is based on a rectangular shape. However, depending on the component to be treated, it is possible for the treatment chamber to be of any suitable shape. One particularly useful shape for treating components is an annular shape, in which the treatment parts of the component are inserted into the treatment chamber through either and inner annular side wall or an outer annular side wall of the treatment chamber.

The term "heat treatment" used herein includes heating, maintaining at temperature, and cooling. Cooling can be carried out by appropriate refrigeration of the fluidising gas and/or particulate. Fluidised beds have many other uses in industry, including carrying out chemical reactions. The preferred embodiments of the invention allow any suitable fluidised bed process to be adapted by allowing a component to be treated by introduction at the side of the fluidised bed. This allows local, more uniform media flow around the treatment part of the component. Further applications in industry include:

Drying
Pre-heating
Surface engineering
Cooling
Combustion
Nitriding
Flame free heater for repair in a hazardous environment
Sterilisation
Shrink fitting While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

All references referred to above are hereby incorporated by reference.

The invention claimed is:

1. A process for the treatment of a component using a fluidised bed of solid particles, the process comprising:

forming the fluidised bed in a treatment chamber and retaining the fluidised bed in the treatment chamber by one or more containment surfaces;

placing at least one treatment part of the component in the fluidised bed and locating at least one non-treatment part of the component outside the chamber and out of contact with the fluidised bed; and maintaining the at least one treatment part in a stationary position with respect to the treatment chamber during treatment, wherein the boundary between the at least one treatment part and the at least one non-treatment part of the component is defined by a boundary containment surface of the treatment chamber at a fixed location with respect to the component, the boundary containment surface being a sealing surface directly contacting the component when the at least one treatment part is placed in the fluidised bed, the component is initially installed in the treatment chamber before the solid particle bed is fluidised so that the at least one treatment part of the component is located above the surface of the solid particle bed before fluidisation, and on fluidisation, the at least one treatment part of the component is then completely submerged under the rising surface of the fluidised bed.

2. A process according to claim 1 wherein fluidisation of the bed is by a flow of fluidising gas.

3. A process according to claim 1 wherein the treatment chamber has a side wall, the component being disposed with respect to the treatment chamber so that the treatment part of the component is located within the treatment chamber on one side of the side wall and so that the non-treatment part of the component is located on the other side of the side wall, outside the treatment chamber.

4. A process according to claim 3 wherein the side wall is adapted to the shape of the component, having one or more apertures corresponding in shape and location to the treatment parts of the component.

5. A process according to claim 1 wherein the sealing surface includes at least one seal member to seal between the component and the treatment chamber.

6. A process according to claim 1 wherein the component has two or more treatment parts which are treated in the fluidised bed simultaneously.

7. An apparatus for the treatment of a component using a fluidised bed, the apparatus comprising:

a treatment chamber, the fluidised bed in use being retained in the treatment chamber by one or more containment surfaces, the apparatus being adapted to allow at least one treatment part of the component to be placed in the fluidised bed and at least one non-treatment part of the component to be located outside the chamber and out of contact with the fluidised bed, wherein in use the boundary between the at least one treatment part and the at least one non-treatment part of the component is defined by a boundary containment surface of the treatment chamber at a fixed location with respect to the component, the boundary containment surface being a sealing surface directly contacting the component when the at least one treatment part is placed in the fluidised bed, the treatment chamber is configured to receive the component in one orientation of the treatment chamber, and then to treat the component in another orientation of the treatment chamber, and the sealing surface comprises one or more openings for receiving the component, and the treatment chamber is movable to the one orientation in which the one or more openings for receiving the component face substantially upwardly and is subsequently movable to the another orientation in which the fluidised bed covers the part of the component projecting into the treatment chamber.

8. An apparatus according to claim 7 wherein the apparatus is adjustable in order to adjust the position of the component with respect to the fluidised bed.

9. A kit of parts suitable for assembling an apparatus according to claim 7, wherein the kit includes the boundary containment surface as one of two or more interchangeable boundary containment surfaces of different shape, in order to adapt the treatment chamber to different shapes of specific components to be treated by selection of at least one of the two or more interchangeable boundary containment surfaces to be used in assembling the apparatus.

10. A kit according to claim 9 wherein the interchangeable boundary containment surfaces are provided by interchangeable side walls of the apparatus.

* * * * *